US006684755B2

(12) United States Patent
Boyd et al.

(10) Patent No.: US 6,684,755 B2
(45) Date of Patent: Feb. 3, 2004

(54) CRANKSHAFT, COMPRESSOR USING CRANKSHAFT, AND METHOD FOR ASSEMBLING A COMPRESSOR INCLUDING INSTALLING CRANKSHAFT

(75) Inventors: Gordon T. Boyd, Knoxville, TN (US); Robert D. Douglas, Bristol, VA (US); Joseph T. Hill, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 35 days.

(21) Appl. No.: 10/056,075

(22) Filed: Jan. 28, 2002

(65) Prior Publication Data

US 2003/0140780 A1 Jul. 31, 2003

(51) Int. Cl.[7] ..... F01B 1/02
(52) U.S. Cl. ..... 92/74; 29/888.02
(58) Field of Search ..... 92/73, 74, 138; 417/534, 539; 29/221, 888.02

(56) References Cited

U.S. PATENT DOCUMENTS

| | | | | |
|---|---|---|---|---|
| 1,202,741 A | | 10/1916 | Landgraf | |
| 1,251,389 A | | 12/1917 | Lasche | |
| 1,901,175 A | | 3/1933 | Lack | |
| 2,325,804 A | | 8/1943 | Shoemaker | |
| 2,524,207 A | | 10/1950 | Palmer | 74/603 |
| 2,555,809 A | | 6/1951 | Naab | |
| 2,815,901 A | | 12/1957 | Hale | |
| 3,195,420 A | | 7/1965 | Johannsen | |
| 3,401,873 A | | 9/1968 | Privon et al. | |
| 3,747,433 A | | 7/1973 | Crowe | 74/598 |
| 3,807,907 A | | 4/1974 | Gannaway | 417/415 |
| 3,985,475 A | * | 10/1976 | Gatecliff | 417/539 |
| 4,090,430 A | | 5/1978 | Matsumoto et al. | 92/71 |
| 4,273,519 A | | 6/1981 | Gannaway | 417/273 |
| 4,316,705 A | | 2/1982 | Siewert | 417/273 |
| 4,352,640 A | | 10/1982 | Takamatsu et al. | 417/273 |
| 4,373,876 A | | 2/1983 | Nemoto | 417/534 |
| 4,399,669 A | | 8/1983 | Jacobs | 62/469 |
| 4,450,754 A | | 5/1984 | Liljequist | 92/138 |
| 4,485,769 A | | 12/1984 | Carson | 123/61 R |
| 4,492,127 A | | 1/1985 | Kuhn et al. | 74/50 |
| 4,494,447 A | | 1/1985 | Sisk | 92/13.3 |
| 4,543,919 A | | 10/1985 | Carson | 123/56 BC |
| 4,614,169 A | | 9/1986 | Figliuzzi | 123/54 R |
| 4,822,253 A | | 4/1989 | Nuber | 417/364 |
| 4,830,589 A | * | 5/1989 | Pareja | 417/221 |
| 4,988,269 A | | 1/1991 | Blass | 417/312 |
| 5,022,835 A | | 6/1991 | Da Costa | 418/63 |
| 5,168,960 A | * | 12/1992 | DiFlora | 417/368 |
| 5,237,892 A | | 8/1993 | Fry | 74/603 |
| 5,326,231 A | * | 7/1994 | Pandeya et al. | 29/888.02 |
| 5,367,909 A | | 11/1994 | Heilman et al. | 73/468 |
| 5,435,232 A | | 7/1995 | Hammerton | 92/140 |
| 5,625,945 A | | 5/1997 | Paro | 29/888.08 |
| 5,720,241 A | | 2/1998 | Gail | 123/44 C |
| 5,842,405 A | | 12/1998 | Schaefer et al. | 92/84 |
| 5,897,302 A | | 4/1999 | Siegel et al. | 417/521 |
| 5,951,261 A | * | 9/1999 | Paczuski | 417/221 |
| 6,092,993 A | * | 7/2000 | Young et al. | 417/221 |
| 6,190,137 B1 | * | 2/2001 | Robbins et al. | 417/221 |

* cited by examiner

*Primary Examiner*—Edward K. Look
*Assistant Examiner*—Igor Kershteyn
(74) *Attorney, Agent, or Firm*—Finnegan, Henderson, Farabow, Garrett & Dunner, LLP

(57) ABSTRACT

A crankshaft having at least two eccentric members of different diameter and a method of assembling a reciprocating compressor using a crankshaft having at least two eccentric members of different diameter are provided. A crankshaft having two eccentric members of different diameter is provided for more easily assembling a four-cylinder reciprocating compressor. The eccentric member having a smaller diameter is more easily inserted through apertures of connecting rods having a larger diameter than the eccentric member.

21 Claims, 3 Drawing Sheets

CRANKSHAFT, COMPRESSOR USING CRANKSHAFT, AND METHOD FOR ASSEMBLING A COMPRESSOR INCLUDING INSTALLING CRANKSHAFT

BACKGROUND OF THE INVENTION

The present invention relates generally to reciprocating compressors. More particularly, the present invention relates to a crankshaft having at least two eccentric members of different diameter and a method of assembling a reciprocating compressor using a crankshaft having at least two eccentric members of different diameter.

Reciprocating compressors are known to have many different configurations. One well known configuration is commonly referred to as an in-line, two-cylinder compressor. In this configuration, the compressor includes a block having a side defining two adjacent cylinders, and a crankshaft having two eccentric members separated by a transfer section. The eccentric members rotatably support respective connecting rod and piston assemblies within respective cylinders of the block.

During operation of an in-line, two-cylinder compressor, a motor rotates the crankshaft resulting in the eccentric motion of each of the eccentric members. As the eccentric members rotate, the respective connecting rod and piston assemblies reciprocate within each of the two cylinders.

One efficient method of assembling an in-line, two-cylinder compressor as described includes assembling the pistons to respective connecting rods. Thereafter, the connecting rod and piston assemblies are inserted into the respective cylinders of the block. After the connecting rod and piston assemblies have been inserted into the block, the crankshaft is inserted into the block such that the eccentric members are inserted through receiving apertures of the connecting rods in ends opposite those to which the pistons are attached.

Another compressor configuration that has been found useful is referred to as the four-cylinder compressor. In one known type of four-cylinder compressor, a block is provided having two opposing sides with each side including two adjacent cylinders. A connecting rod and piston assembly is provided in each cylinder and a crankshaft is provided having two eccentric members each rotatably supporting two connecting rod and piston assemblies located in cylinders on opposite sides of the block. During operation, a motor rotates the crankshaft resulting in an eccentric motion of the eccentric members. As each eccentric member rotates, the two connecting rod and piston assemblies supported on a given eccentric member travel in the same direction in a reciprocating manner.

The crankshaft for a four-cylinder reciprocating compressor must be altered to increase the axial width of the eccentric members so that they each may rotatably support two connecting rod and piston assemblies instead of one. Due to the increased axial width of each eccentric member required for supporting two connecting rod and piston assemblies instead of one, the length of the transfer section between the eccentric members is reduced. When this length is reduced, it becomes more difficult to insert the eccentric members of the crankshaft through the apertures of the connecting rods. This makes it more difficult to assemble the compressor efficiently and economically.

Possible solutions to this problem include reducing the cross-section of the transfer section and/or assembling the connecting rods around the eccentric members after the crankshaft has been inserted into the block. Unfortunately, neither of these solutions is optimum. First, when the cross-section of the transfer section is reduced, the strength and reliability of the crankshaft may also be reduced. Second, assembling the connecting rods around the eccentric members after the crankshaft has been installed in the block requires two-piece connecting rods. The use of two-piece connecting rods increases the number of parts, thereby also increasing the complexity of assembling the compressor. This may result in increased manufacturing costs.

In light of the foregoing, there is a need for a device and method for efficiently and economically assembling a four-cylinder reciprocating compressor.

SUMMARY OF THE INVENTION

Accordingly, the present invention is directed to a device and method for efficiently and economically assembling a reciprocating compressor.

According to the present invention, eccentric members on the crankshaft are designed to have different diameters. By providing eccentric members having different diameters, the eccentric member having a smaller diameter is more easily inserted first through the connecting rod and piston assemblies having the larger diameter for accommodating the eccentric member having a larger diameter. The crankshaft is then inserted further, until the smaller diameter eccentric fits within the smaller diameter connecting rod and the larger diameter eccentric fits within the rod to match the larger diameter eccentric. As a result, it is not required that the cross-section of the transfer section be reduced, nor is it required that the connecting rods be of two-piece construction in order for the compressor to be assembled. Consequently, by providing a crankshaft having eccentric members of different diameters, a reciprocating compressor may be more efficiently and economically assembled.

The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention as embodied and broadly described herein, one aspect of the invention is directed to a crankshaft for a reciprocating compressor. The crankshaft includes an elongated shaft defining a longitudinal axis, a first eccentric member having a first diameter and a first center offset from the longitudinal axis of the elongated shaft. The crankshaft also includes a second eccentric member having a second diameter and a second center offset from the first center and the longitudinal axis of the elongated shaft, with the second diameter being larger than the first diameter. The crankshaft further includes a transfer section connecting the first eccentric member to the second eccentric member, with the transfer section including at least one ramp portion.

In another aspect, the invention provides a compressor including a block defining an internal cavity, at least one aperture in communication with the internal cavity, and at least two cylinders. The compressor further includes a crankshaft received within the internal cavity, with the crankshaft including an elongated shaft defining a longitudinal axis, a first eccentric member defining a first diameter and a first center offset from the longitudinal axis, and a second eccentric member defining a second diameter and a second center offset from the first center and the longitudinal axis. The first diameter is smaller than the second diameter. The compressor further includes a first connecting rod having an aperture defining a diameter substantially equal to the first diameter with the first eccentric member rotatably supporting the first connecting rod. The compressor also includes a second connecting rod having an aperture defining a diameter substantially equal to the second diameter, with the second eccentric member rotatably supporting the second connecting rod.

In yet another aspect, the invention provides a method for assembling a compressor having a block defining an internal cavity, at least one aperture in communication with the internal cavity, and a first cylinder and second cylinder. The method includes inserting first connecting rod into the first cylinder of the block and inserting a second connecting rod into the second cylinder of the block. The method further includes inserting a crankshaft through the aperture in the block, the crankshaft having a first eccentric member having a first diameter and a second eccentric member having a second diameter larger than the first diameter. The method also includes inserting the crankshaft into the block such that the first eccentric member is passed through an aperture of the second connecting rod having a diameter substantially equal to the second diameter of the second eccentric member, and inserting the crankshaft further into the block such that the first eccentric member is received within an aperture in the first connecting rod having a diameter substantially equal to the first diameter of the first eccentric member.

Further, the second eccentric member is received in the aperture in the second connecting rod, whereby the first eccentric member rotatably supports first connecting rod and the second eccentric member rotatably supports the second connecting rod.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE EMBODIMENTS

Figure 1:
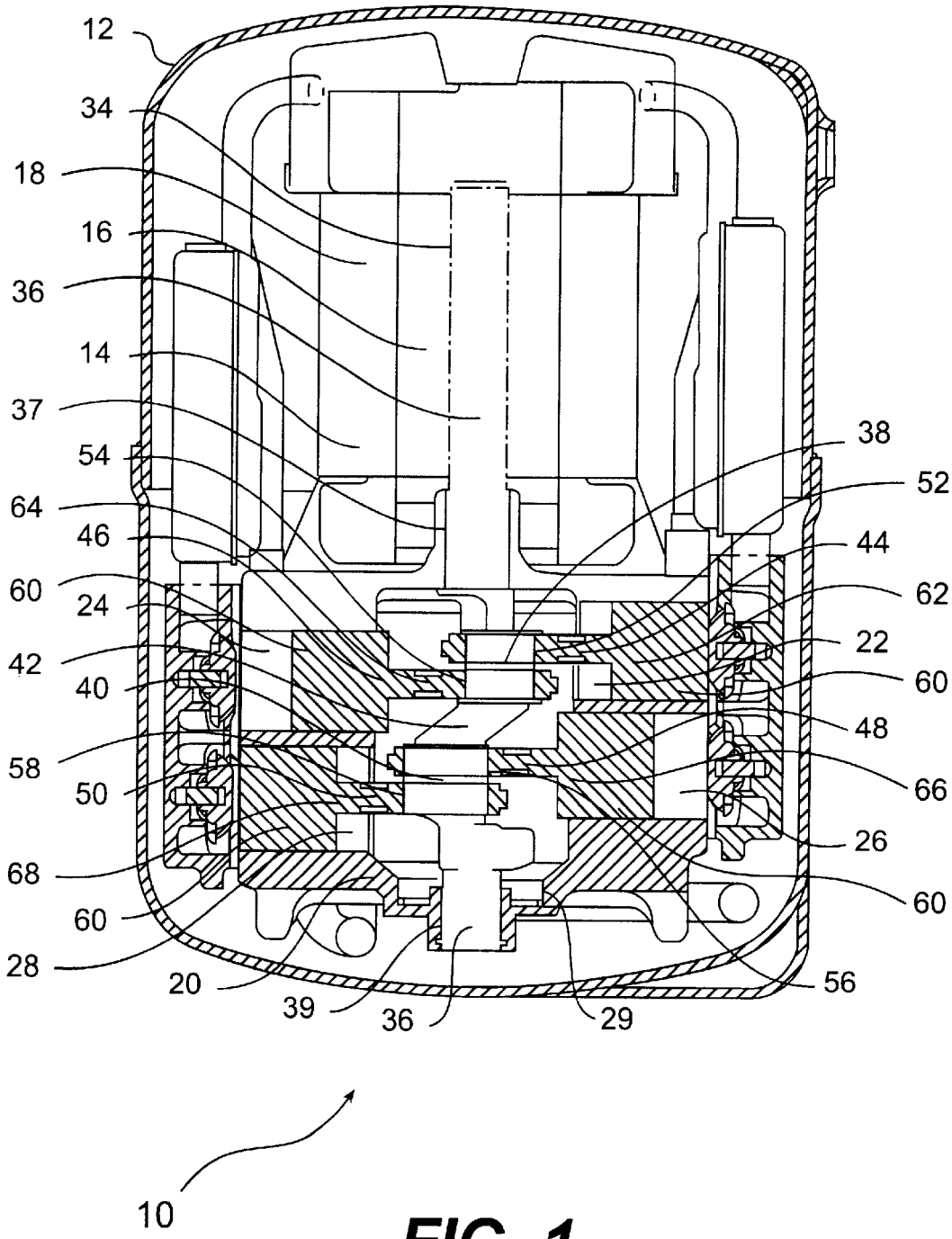
FIG. 1 is a partial section view of one embodiment of a four-cylinder compressor according to one aspect of the invention.

Reference will now be made in detail to the present embodiments of the invention, an example of which is illustrated in the accompanying drawings. Wherever possible, the same reference numbers will be used throughout the drawings to refer to the same or like parts.

In accordance with the present invention, a crankshaft for a reciprocating compressor is provided. The present invention contemplates that the reciprocating compressor may have multiple configurations including, but not limited to, in-line, two-cylinder compressors, and four-cylinder compressors. Reference is made to U.S. Pat. No. 5,326,231, for a more detailed understanding of a four-cylinder compressor, the disclosure of which is incorporated herein by reference and the description of which will not be discussed further here.

In the preferred embodiment, a reciprocating compressor is provided with a block having cylinders. Within the block, a crankshaft is provided that includes two eccentric members of different diameters for imparting reciprocating motion to connecting rod and piston assemblies rotatably supported on the eccentric members. An exemplary embodiment consistent with the present invention is illustrated in FIG. 1 and is generally designated by reference numeral 10.

FIG. 1 shows an embodiment of a four-cylinder compressor 10 according to one aspect of the invention. An example of such a compressor might be used in a refrigeration system and have a capacity ranging from about 5 tons to about 15 tons and be driven by either a single-phase or three-phase electric motor. The four-cylinder compressor 10 includes a housing 12, containing a motor 14 having a rotor 16 and a stator 18, and a compressor block 20.

Figure 2:
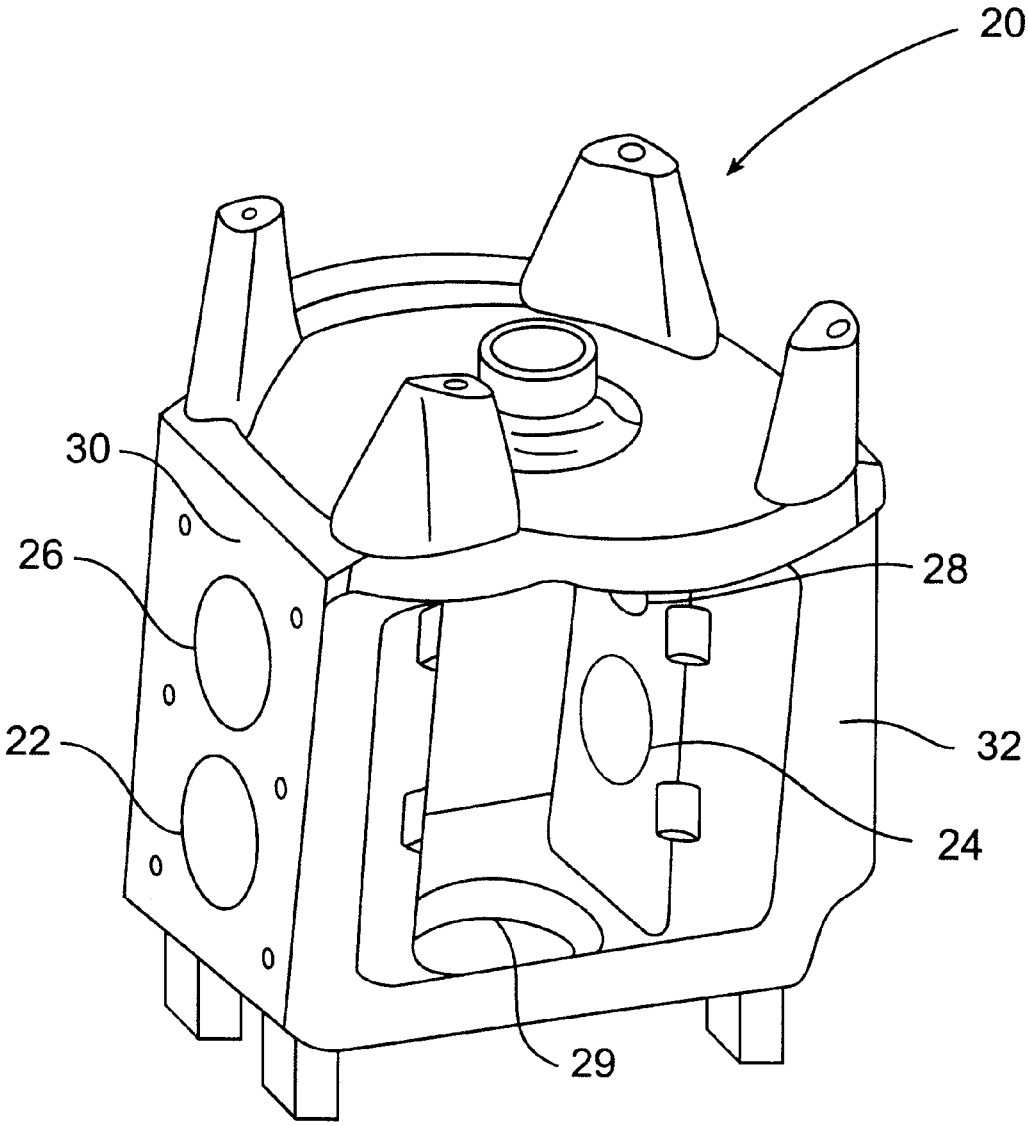
FIG. 2 is a perspective view of a compressor block according to another aspect of the invention.

As shown in FIG. 2, the compressor block 20, defines four cylinders 22, 24, 26, and 28, two on one side 30, two on the opposite side 32 of block 20, and an aperture 29 in one end of the block 20. Although the four-cylinder compressor of this embodiment has an opposed cylinder configuration, two cylinders on one side of the block and two cylinders on an opposite side of the block, the cylinders could be arranged in other configurations including, but not limited to, an in-line configuration. Note also that a reciprocating compressor in accordance with the invention may include a number of cylinders other than two or four.

Figure 4:
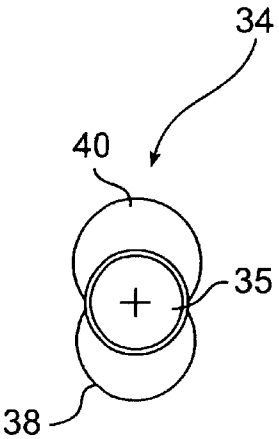
FIG. 4 is an end view of the crankshaft shown in FIG. 3.
Figure 3:
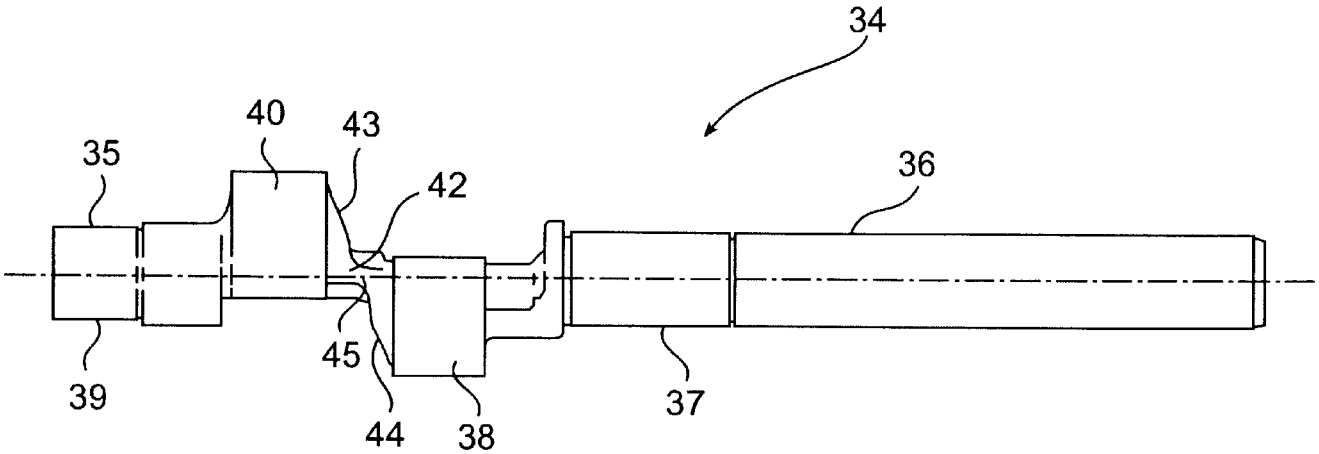
FIG. 3 is a plan view of a crankshaft according to one aspect of the invention.

As shown in FIG. 1, the motor 14 is connected to a crankshaft 34 supported by the block 20 at bearing surfaces 37 and 39. The crankshaft 34, as also shown in FIGS. 3 and 4, includes an elongated shaft 35 having a longitudinal axis, a motor shaft 36, and eccentric members 38 and 40, which are spaced and connected by a transfer section 42. As an example, the axial length of the transfer section 42 might be on the order of about 1.000 inches for a crankshaft having eccentrics with an axial width dimension on the order of about 1.320 inches.

The transfer section 42 includes a pair of ramp portions 43 and 44 that extend obliquely with respect to the longitudinal axis of the crankshaft 34, and a portion 45 that extends in a direction parallel to the longitudinal axis of the crankshaft 34. The ramp portions 43 and 44 of the transfer section 42 provide additional reinforcement against failure due to torsional, axial, and bending loads. Additionally, the ramp portions 43 and 44 assist with the insertion of the crankshaft 34 into the block 20 during assembly of the compressor 10.

As shown in FIGS. 3 and 4, the eccentric member 38 has a diameter dimension smaller than the diameter dimension of the eccentric member 40. An example of the difference in the diameters would be on the order of about 0.125 inches for a crankshaft having a larger diameter eccentric member with a diameter on the order of about 1.750 inches and a smaller diameter eccentric member with a diameter on the order of about 1.625 inches. The eccentric member 38 supports connecting rods 44 and 46, and the eccentric member 40 supports connecting rods 48 and 50. As an example, the connecting rods 44 and 46, and connecting rods 48 and 50, will be spaced apart on their respective eccentrics on the order of about 0.060 inches for a crankshaft having eccentrics with an axial width dimension on the order of about 1.320 inches. This spacing is generally substantially maintained by the spacing of the cylinders such as 22, 24, 26, and 28.

The connecting rods 44, 46, 48, and 50 are provided with apertures and/or sleeves 52, 54, 56, and 58. Preferably, these apertures and/or sleeves are single-piece construction for receipt of the eccentric members 38 and 40. Connecting rods having alternative constructions such as, but not limited to, two-piece construction could also be used. The apertures 52 and 54 define a diameter dimension substantially equal to the diameter dimension of the eccentric member 38, and the diameter dimension of the apertures 56 and 58 have a diameter dimension substantially equal to the diameter dimension of the eccentric member 40. As is known, the relative dimensions are such that the connecting rods snugly fit about the eccentrics and yet are freely rotatable about the eccentrics. For example, a clearance between the connecting rods and eccentrics might be on the order of about 0.001 inches for a crankshaft having eccentrics with diameters ranging from about 1.6000 inches to about 1.750 inches. Additionally, connecting rods 44, 46, 48, and 50 are connected to pistons 60. It is also contemplated that a crankshaft may be provided with more than two eccentric members for supporting connecting rods for reciprocating compressors having more cylinders, for example.

During assembly, the block 20 is oriented such that the crankshaft 34 can be inserted into the block 20 through aperture 29 by inserting motor shaft 36 first. Preferably, the pistons 60 are attached to the connecting rods 44, 46, 48, and 50 forming connecting rod and piston assemblies 62, 64, 66, and 68, respectively. The connecting rod and piston assemblies 62, 64, 66, and 68 are then inserted into the cylinders 22, 24, 26, and 28, respectively. Once the connecting rod and the piston assemblies 62, 64, 66, and 68 are in the cylinders 22, 24, 26, and 28, the crankshaft 34 is inserted into the block 20 through the aperture 29 defined at one end of the block 20 such that the motor shaft 36 and eccentric member 38 are first passed through the apertures 56 and 58 of the connecting rod and piston assemblies 66 and 68. Since the eccentric member 38 has a smaller diameter dimension than the apertures 56 and 58, the crankshaft 34 is more easily threaded through the apertures 56 and 58. Once the eccentric member 38 has been successfully inserted through the apertures 56 and 58, the crankshaft 34 is rotated about its longitudinal axis in order to aid in the axial alignment of the eccentrics and apertures of the connecting rods. The crankshaft 34 is then moved to its final position by inserting the crankshaft 34 further into the block 20 until the eccentric member 38 is aligned with and supports the connecting rod and piston assemblies 62 and 64, and the eccentric member 40 is aligned with and supports the connecting rod and piston assemblies 66 and 68.

The insertion of the crankshaft 34 into its final position is made easier by the ramp portions 43 and 44 on the transfer section 42 of the crankshaft 34. The ramp portions 43 and 44 provide a relatively smooth transition surface for the apertures 56 and 58 of the connecting rod and piston assemblies 66 and 68 as they traverse the transfer section 42 when the crankshaft 34 is inserted further into the block 20.

Once the crankshaft had been secured within the block 20, the rotor 16 of the motor 14 is installed on the motor shaft 36 of the crankshaft 34. Although many alternative means are contemplated for securing the rotor 16 to the motor shaft 36, as an example, the rotor 16 may be installed by heating the rotor 16 to a temperature ranging from about 300 degrees Fahrenheit to about 400 degrees Fahrenheit, and properly positioning the rotor 16 onto the motor shaft 36 of the crankshaft 34. Once the rotor 16 cools, the rotor 16 becomes securely attached to the motor shaft 36 of the crankshaft 34. After the rotor 16 has be attached to the crankshaft 34, the stator 18 and remainder of the motor are attached to the block 20.

During operation, the motor 14 drives the crankshaft 34 resulting in a rotation of the crankshaft 34. As the crankshaft 34 rotates, the eccentric members 38 and 40 displace the connecting rod and piston assemblies 62, 64, 66, and 68 resulting in a reciprocating linear displacement of the pistons 60. The reciprocating linear displacement of the pistons 60 compresses the fluid to be compressed.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A crankshaft for a reciprocating compressor including at least two connecting rods, each having a connecting rod aperture, the crankshaft comprising:

an elongated shaft defining a longitudinal axis;

a first eccentric member having a first diameter and a first center offset from the longitudinal axis;

a second eccentric member having a second diameter and a second center offset from the first center and the longitudinal axis, the second diameter being larger than the first diameter; and a transfer section connecting the first eccentric member to the second eccentric member, wherein the first and second diameters of the first and second eccentric members respectively define peripheral portions of the first and second eccentric members, and wherein the transfer section includes first and second ramp portions respectively extending substantially to the peripheral portions of the first and second eccentric members, thereby providing a substantially smooth transition surface for being inserted through the connecting rod apertures.

2. The crankshaft of claim 1, wherein the transfer section comprises two ramp portions.

3. The crankshaft of claim 1, wherein the first center is offset from the longitudinal axis in a direction opposite the offset of the second center.

4. The crankshaft of claim 1, wherein the first eccentric member and the second eccentric member are circular.

5. The crankshaft of claim 1, wherein the first eccentric member and the second eccentric member have bearing surfaces defining a width for rotatably supporting at least one connecting rod.

6. The crankshaft of claim 1, wherein at least one of the first eccentric member and the second eccentric member has a bearing surface defining a width for rotatably supporting two connecting rods.

7. The crankshaft of claim 6, wherein the first eccentric member and the second eccentric member each have bearing surfaces defining a width for rotatably supporting two connecting rods.

8. The crankshaft of claim 1, wherein the transfer section comprises a portion parallel to the longitudinal axis for aligning connecting rods with cylinders in a compressor block.

9. A compressor comprising:

a block defining an internal cavity, at least one aperture in communication with the internal cavity, and at least two cylinders;

a crankshaft received within the internal cavity, the crankshaft comprising:

an elongated shaft defining a longitudinal axis;

a first eccentric member having a first diameter and a first center offset from the longitudinal axis;

a second eccentric member having a second diameter and a second center offset from the first center and the longitudinal axis, wherein the first diameter is smaller than the second diameter;

a first connecting rod having an aperture defining a diameter substantially equal to the first diameter, the first eccentric member rotatably supporting the first connecting rod; and a second connecting rod having an aperture defining a diameter substantially equal to the second diameter, the second eccentric member rotatably supporting the second connecting rod.

10. The compressor of claim 9, further comprising a third connecting rod rotatably disposed on the first eccentric member.

11. The compressor of claim 10, further comprising a fourth connecting rod rotatably disposed on the second eccentric member.

12. The compressor of claim 9, wherein the first connecting rod includes a sleeve for accepting the first eccentric member.

13. The compressor of claim 12, wherein the sleeve is defined by a single-piece construction.

14. The compressor of claim 12, wherein the first connecting rod includes an end configured to engage a piston.

15. The compressor of claim 9, wherein the crankshaft comprises a transfer section connecting the first eccentric member to the second eccentric member, the transfer section having at least one ramp portion.

16. The compressor of claim 9, wherein the crankshaft comprises a transfer section connecting the first eccentric member to the second eccentric member, the transfer section having two ramp portions.

17. The compressor of claim 15, wherein a portion of the transfer section extends parallel to the longitudinal axis such that the first connecting rod and the second connecting rod are aligned with first and second cylinders in the block.

18. A method for assembling a compressor having a block defining an internal cavity, at least one aperture in communication with the internal cavity, and a first cylinder and a second cylinder, the method comprising:

inserting a first connecting rod into the first cylinder of the block;

inserting a second connecting rod into the second cylinder of the block;

inserting a crankshaft through the aperture in the block, the crankshaft having a first eccentric member defining a first diameter and a second eccentric member defining a second diameter larger than the first diameter;

inserting the crankshaft further into the block such that the first eccentric member is passed through an aperture in the second connecting rod having a diameter substantially equal to the second diameter of the second eccentric member; and inserting the crankshaft further into the block such that the first eccentric member is received within an aperture in the first connecting rod having a diameter substantially equal to the first diameter of the first eccentric member, and the second eccentric member is received in the aperture in the second connecting rod, wherein the first eccentric member rotatably supports the first connecting rod and the second eccentric member rotatably supports the second connecting rod.

19. The method of claim 18, wherein pistons are attached to the connecting rods prior to inserting the first and second connecting rods into the first and the second cylinders of the block.

20. The method of claim 18, wherein the block further comprises a third and a fourth cylinder, the method further comprising:

inserting a third connecting rod having an aperture into the third cylinder;

inserting a fourth connecting rod having an aperture into the fourth cylinder;

inserting the crankshaft into the block such that the first eccentric member passes through the apertures of the second and the fourth connecting rods; and inserting the crankshaft further into the block until the first eccentric member is received within the apertures of the first and the third connecting rods, and second eccentric member is received within the apertures of the second and the fourth connecting rods, wherein the first eccentric member rotatably supports the first and the third connecting rods, and the second eccentric member rotatably supports the second and the fourth connecting rods.

21. The method of claim 18, further comprising:

installing a motor rotor onto the crankshaft after the first eccentric member is received by the first connecting rod and the second eccentric member is received by the second connecting rod; and subsequently installing a motor stator around the motor rotor and to the block.

* * * * *